US009538592B2

(12) United States Patent
Radermacher et al.

(10) Patent No.: US 9,538,592 B2
(45) Date of Patent: Jan. 3, 2017

(54) LED LIGHTING SYSTEM

(71) Applicant: KONINKLIJKE PHILIPS N.V., Eindhoven (NL)

(72) Inventors: Harald Josef Günther Radermacher, Aachen (DE); Geert Willem Van Der Veen, Eindhoven (NL); Wilhelmus Josephus Cornelissen, Eindhoven (NL); Lino Adriaan Nicolaas Wilhelm De Wit, Eindhoven (NL); Tijmen Cornelis Van Bodegraven, Eindhoven (NL); Peter Hubertus Franciscus Deurenberg, s-Hertogenbosch (NL); Patrick Alouisius Martina De Bruycker, Nuenen (NL); Klaas Jacob Lulofs, Eindhoven (NL)

(73) Assignee: PHILIPS LIGHTING HOLDING B.V., Eindhoven (NL)

( * ) Notice: Subject to any disclaimer, the term of this patent is extended or adjusted under 35 U.S.C. 154(b) by 135 days.

(21) Appl. No.: 14/390,664

(22) PCT Filed: Apr. 2, 2013

(86) PCT No.: PCT/IB2013/052628

§ 371 (c)(1),
(2) Date: Oct. 3, 2014

(87) PCT Pub. No.: WO2013/150447

PCT Pub. Date: Oct. 10, 2013

(65) Prior Publication Data

US 2015/0035452 A1 Feb. 5, 2015

Related U.S. Application Data

(60) Provisional application No. 61/620,495, filed on Apr. 5, 2012.

(30) Foreign Application Priority Data

Apr. 5, 2012 (EP) ..... 12163355

(51) Int. Cl.
*H05B 33/08* (2006.01)

(52) U.S. Cl.
CPC ..... *H05B 33/0815* (2013.01); *H05B 33/0854* (2013.01)

(58) Field of Classification Search
CPC . H05B 33/0818; H05B 33/0815; H05B 37/02; H05B 33/0851; H05B 33/0809; H05B 33/08; H05B 33/0824; H05B 33/0866; H05B 33/0845; H05B 33/0884; H05B 33/0887; H05B 33/0848; Y02B 20/347

(Continued)

(56) References Cited

U.S. PATENT DOCUMENTS 6,987,787 B1 1/2006 Mick
9,101,019 B2 * 8/2015 Jong ..... H05B 33/0818

(Continued)

FOREIGN PATENT DOCUMENTS

WO 2008112820 A2 9/2008
WO 2013064973 A1 5/2013
WO 2013072784 A1 5/2013

*Primary Examiner* — Haissa Philogene

(57) ABSTRACT

The invention relates to LED lighting system comprising a power supply circuit and one or more LED modules. The power supply circuit is equipped with input terminals (K1, K2) for connection to a supply voltage source and first and second output terminals (K3, K4), and a driver circuit (I, II) coupled between the input terminals and the first and second output terminals for generating a LED current. The driver circuit (I, II) comprises a driver control circuit (II) equipped with an input terminal (K7) for increasing or decreasing the LED current in dependency of a signal present at the input terminal of the driver control circuit. The one or more LED modules comprise first and second input terminals (K5, K6) for connection to respectively the first and second output terminals of the power supply circuit, a series arrangement of a LED load (LS) and a current sensor (R1) coupled between the input terminals, a module control circuit for generating a current control signal at an output terminal of the module control circuit and coupled to the current sensor and to a reference signal generator (R3, R4, R5, Z1) for generating a reference signal representing a desired magnitude of the LED current, wherein the current control signal has a first value in case the desired value of the LED current is lower than the measured value of the LED current and a second value in case the desired value of the LED current is higher than the measured value of the LED current, and coupling circuitry (D1; Sg, DC, C1, C2) coupled during operation between the output terminal of the module control circuit and the input terminal of the driver control circuit, for (Continued)

communicating the first value of the current control signal to the input terminal of the driver control circuit and for blocking the second value, and wherein the signal at the input terminal of the driver control circuit has a default value when all the current control signals have their second value.

12 Claims, 6 Drawing Sheets

(58) Field of Classification Search
USPC ..... 315/291, 307, 224, 247, 50, 312, 309,315/311, 126
See application file for complete search history.

(56) References Cited

U.S. PATENT DOCUMENTS

2005/0023536 A1 2/2005 Shackle
2005/0093488 A1 5/2005 Hung et al.
2007/0236158 A1 10/2007 Ball et al.
2008/0150450 A1 6/2008 Starr et al.
2008/0218100 A1 9/2008 Parikh
2008/0265799 A1* 10/2008 Sibert ..... 315/292
2009/0015178 A1 1/2009 Liu
2009/0134816 A1 5/2009 Sloan et al.
2009/0237005 A1 9/2009 Chung et al.
2010/0052552 A1 3/2010 Kimura
2011/0210675 A1 9/2011 Hamamoto et al.
2011/0227496 A1 9/2011 Lin et al.
2011/0273112 A1* 11/2011 Lee et al. ..... 315/297
2011/0279040 A1* 11/2011 Briggs et al. ..... 315/136
2012/0025717 A1* 2/2012 Klusmann et al. ..... 315/152
2012/0032605 A1* 2/2012 Peng ..... 315/219
2012/0032612 A1* 2/2012 Antony et al. ..... 315/297
2012/0074866 A1 3/2012 Zhang et al.
2015/0123549 A1* 5/2015 Radermacher ..... H05B 33/0848 315/185 R

* cited by examiner

LED LIGHTING SYSTEM

CROSS-REFERENCE TO PRIOR APPLICATIONS

This application is the U.S. National Phase application under 35 U.S.C. §371 of International Application No. PCT/IB2013/052628, filed on Apr. 2, 2013, which claims the benefit of U.S. Provisional Patent Application No. 61/620,495, filed on Apr. 5, 2012 or European Patent Application No. 12163355.6 filed Apr. 5, 2012. These applications are hereby incorporated by reference herein.

FIELD OF THE INVENTION

The invention relates to a LED lighting system comprising a power supply circuit and one or more LED modules. More in particular the invention relates to a LED lighting system, wherein the power supply circuit adjusts the power supplied to the LEDs in the LED modules in dependency of signals generated by circuitry comprised in the LED modules, said signals in turn depending on the nominal power of the LEDs comprised in the LED module and preferably also on the temperature of the LEDs.

BACKGROUND OF THE INVENTION

Lighting systems based on LEDs are used on an increasing scale. LEDs have a high efficiency and a long life time. In many lighting systems, LEDs also offer a higher optical efficiency than other light sources. As a consequence, LEDs offer an interesting alternative for the well-known light sources such as fluorescent lamps, high intensity discharge lamps or incandescent lamps.

The lighting systems based on LEDs often comprise a power supply circuit that supplies power to the LEDs comprised in one or more LED modules that are connected to output terminals of the power supply circuit during operation. Typically the total current supplied by the power supply circuit depends on the number of LED modules connected to power supply circuit and more in particular to the nominal current suitable for each of the LED modules and also on the temperature of the LED modules. The LED modules LM comprised in a LED lighting system called Fortimo manufactured by Philips, that is presently on the market and is schematically shown in FIG. 1, comprise a first resistor Rset having a resistance that represents the nominal current suitable for the LEDs comprised in the LED module, and furthermore comprise a second resistor NTC having a temperature dependent resistance. In case one or more of these LED modules is connected to the power supply circuit PSC, a circuit MC, which is comprised in the power supply circuit PSC, causes a current to flow through the first resistor Rset and another current to flow through the second resistor NTC. The voltages across each of the resistors are measured and the value of the resistance of each of the resistors is determined by the circuit MC from the measured voltage across each of the resistors. From these data, the circuit part MC derives a desired value for the total LED current. A driver circuit DC, which is comprised in the power supply circuit PSC, subsequently adjusts the current supplied to the LED modules to a desired value.

An important disadvantage of this prior art is that three wires are required for connecting the resistors in the LED module to circuitry comprised in the power supply circuit. This makes these existing LED lighting systems rather complex.

SUMMARY OF THE INVENTION

The invention aims to provide a less complex LED lighting system, that is easier to manufacture and also easier to install.

According to a first aspect of the invention a LED lighting system is provided, comprising a power supply circuit and one or more LED modules. The power supply circuit is equipped with:

input terminals for connection to a power supply source and first and second output terminals, and a driver circuit coupled between the input terminals and the first and second output terminals for generating a LED current, the driver circuit comprising a driver control circuit equipped with an input terminal, for increasing or decreasing the LED current in dependency of a signal present at the input terminal of the driver control circuit.

The one or more LED modules comprise:

first and second input terminals for connection to respectively the first and second output terminals of the power supply circuit, a series arrangement of a LED load and a current sensor coupled between the input terminals, a module control circuit for generating a current control signal at an output terminal of the module control circuit and coupled to the current sensor and to a reference signal generator for generating a reference signal representing a desired magnitude of the LED current, wherein the current control signal has a first value in case the desired magnitude of the LED current is lower than the measured magnitude of the LED current and a second value in case the desired magnitude of the LED current is higher than the measured magnitude of the LED current, and a coupling circuit coupled, during operation, between the output terminal of the module control circuit and the input terminal of the driver control circuit, for communicating the first value of the current control signal to the input terminal of the driver control circuit and for blocking the second value, and wherein the signal at the input terminal of the driver control circuit has a default value when all the current control signals have their second value.

During operation the driver control circuit controls the current at a desired value, by increasing and decreasing the LED current in dependency of the signal present at its input terminal. The signal present at the input terminal of the driver control circuit in turn depends on the current control signals present at the output terminal of the module control circuits. As a consequence at most one wire is needed to ensure that information regarding the desired LED current is communicated from a LED module to the power supply circuit.

According to a second aspect a method is provided for operating at least one LED module comprising a LED load by means of a driver circuit comprised in a power supply circuit, the method comprising the following steps:

providing a module control circuit in each LED module for generating a current control signal in dependency of a measured magnitude of the LED current and a desired magnitude of the LED current, the current control signal having a first value in case the desired magnitude of the LED current is lower than the measured magnitude of the LED current and a second value in case the desired magnitude of the LED current is higher than the measured magnitude of the LED current, providing a driver control circuit in the power supply circuit, the driver control circuit being equipped with an input terminal for increasing or decreasing the LED current in dependency of the signal present at the input terminal of the driver control circuit, adjusting the signal at the input terminal of the driver control circuit in dependency of the current control signals.

This method offers the same advantages as a LED lighting system according to the first aspect of the invention.

In a first preferred embodiment of a LED lighting system according to the invention, the coupling circuit comprises a conductive string comprising a unidirectional element, such as a diode, that blocks the second value of the current control signal and conducts the first value of the current control signal.

Preferably, the default value of the signal present at the input terminal of the driver control circuit is chosen such that the LED current is increased when the signal present at the input of the driver control circuit has the default value.

In case the LED lighting system comprises more than one LED module and the first LED module is designed for a lower LED current than the other LED modules, immediately after switch on of the LED lighting system all the current control signals of all the LED modules have the second value and are thus blocked by the unidirectional elements. However, the signal at the input terminal of the driver control circuit has its default value so that the current generated by the power supply circuit and thus also the currents through each of the LED modules increase.

The current control signal of this first module will have its first value after the current through its LED load has reached its proper magnitude. Since the LED loads in the other LED modules are designed for a higher current, the current control signals generated by the other LED modules still have the second value. All current control signals having the second value are still blocked by the unidirectional elements comprised in the coupling circuits and do not influence the signal present at the input terminal of the driver control circuit. However, the unidirectional element present in the coupling circuit between the output terminal of the current module control circuit of the first LED module and the input terminal of the driver control circuit is conductive so that the current control signal of the first LED module requesting a decrease of the current is conducted to the input terminal of the driver control circuit and thus prevails over the current control signals of all the other LED modules requesting a higher current. In this way a too high current through any of the LED loads comprised in the LED modules is prevented.

In another preferred embodiment, the LED modules comprise a signal generator coupled between the output of the module control circuit and the first input terminal, for generating a communication signal and for coupling the communication signal to the first input terminal, when the current control signal has its first value, and wherein the power supply circuit comprises a detection circuit, coupled between the input terminal of the driver control circuit and the first output terminal of the power supply circuit for detecting the communication signal and for controlling the signal at the input terminal of the driver control circuit so that the LED current is decreased in case the communication signal is detected and increased in case the detection circuit does not detect the communication signal, wherein a coupling circuit is formed by the signal generator and the detection circuit.

The communication signal is preferably a high frequency signal wherein the frequency of the communication signal is chosen such that it differs substantially from the operating frequency of any switch mode power supply comprised in the driver circuit to ensure that the detection circuit can more easily discriminate between the communication signal and any signals having the operating frequency of the switch mode power supply that might be comprised in the LED current.

During operation the output terminals of the power supply circuit are connected to the input terminals of the LED modules and the LED modules are connected in parallel. In other words the first input terminals of all the LED modules are connected to each other and to the first output terminal of the power supply circuit. Similarly, the second input terminals of all the LED modules are connected to each other and to the second output terminal of the power supply circuit. In case a current control signal generated by one of the LED modules has its first value, the communication signal is present on the first input terminal of the LED module, superimposed on the LED current, and thus also present on the first output terminal of the power supply circuit. Only in case this communication signal is detected by the detection circuit, the LED current is decreased. In case the communication signal is not present, then the LED current is increased. An important advantage of this second preferred embodiment is that no (additional) wires are needed to communicate information regarding the required LED current magnitude to the LED module to the power supply circuit. It is further noted that also in this other preferred embodiment, in case more than one LED module is connected to the power supply circuit, the total LED current is determined by the first LED module that generates a current control signal which has its first value or, in other words, the first LED module that requests a decrease of the LED current.

In a further preferred embodiment of a LED lighting system according to the invention, the LED lighting system comprises a parameter sensor for sensing a parameter and for generating a current control signal at an output terminal of the parameter sensor equal to the first value or the second value of the current control signals generated by the module control circuits of the LED modules in dependency of the result of the sensing, wherein the output terminal of the parameter sensor is coupled to the input terminal of the driver control circuit via a coupling circuit for conducting the first value and blocking the second value of the sensor signal, and wherein the parameter is chosen from a group comprising the total intensity of the ambient light and the light generated by the LED lighting system, the temperature at a particular spot in the LED lighting system, the presence of persons in the vicinity of the LED lighting system and a signal from a remote control.

In case the parameter represents the total intensity of the light, this intensity is first measured by the parameter sensor and compared with a predetermined reference value representing a desired light intensity. The current control signal is made equal to the first value in case the measured intensity is higher than the predetermined reference value, and equal to the second value in case the measured intensity is lower than the reference value. In the latter case the current control signal, further also referred to as sensor signal, is blocked by the coupling circuit. In the first case the sensor signal causes the driver control circuit to decrease the total LED current to a level at which the measured intensity equals the predetermined reference value.

In case the parameter represents the temperature at a particular spot in the LED lighting system, this temperature is first measured. Also in this case the evaluation involves a comparison of the measured value with a predetermined reference value, representing the highest allowable temperature, and making the sensor signal equal to the first value in case the measured value is higher than the reference value, and equal to the second value in case the measured value is lower than the reference value. In the latter case the sensor signal is blocked by the coupling circuit. In the first case the sensor signal causes the driver control circuit to decrease the total LED current until the measured temperature drops below the predetermined reference. In case the measured temperature stays higher than the predetermined reference value, the total LED current is further reduced to zero, so that the LED lighting arrangement is switched off.

In case the parameter represents the presence of persons in the vicinity of the LED lighting system, the parameter evaluation is a detection of presence of persons. In case a presence is detected the sensor signal is made equal to its second value and in case no presence is detected the sensor signal is made equal to its first value. When the sensor signal has its second value, the sensor signal is blocked so that it does not interfere with the operation of the LED lighting system. In case the parameter evaluation signal has its first value, it is not blocked by the coupling circuit and causes the driver control circuit to decrease the LED current to zero and thus switch off the LED lighting arrangement until a presence is sensed. Alternatively the parameter sensor may additionally comprise a light sensor and control the light intensity at a dimmed level in case no presence is detected.

In case the parameter represents a signal from a remote control, this signal can for example be used to adjust the sensor signal to its first value, so that the LED current generated by the power supply circuit is reduced to zero and the LED lighting system is thus switched off.

It is noted that the intensity of the light, the temperature at a particular spot in the LED lighting system, the presence of persons in the vicinity of the LED lighting system and the signal of a remote control are exemplary parameters. Many other parameters could be sensed by a parameter sensor and used to control the LED lighting arrangement.

In case the parameter sensor is comprised in a LED lighting system according to the first preferred embodiment, the coupling circuit of the parameter sensor preferably comprises a unidirectional element.

In case the parameter sensor is comprised in a LED lighting system according to the other preferred embodiment, the coupling circuit of the parameter sensor preferably comprises a signal generator coupled between the output terminal of the parameter sensor and the first output terminal of the power supply circuit, for generating a communication signal and for coupling the communication signal to the first output terminal of the power supply circuit.

In yet another preferred embodiment of a LED lighting system according to the invention, the module control circuit of the LED modules comprises a comparator having a first input terminal coupled to the current sensor and having a second input terminal coupled to the reference signal generator. In this preferred embodiment, the module control circuit is implemented in a simple and dependable way.

Preferably, one of the input terminals of the comparator is coupled to an output terminal of a current source generating a temperature dependent current. In this way the magnitude of the LED current is not only influenced by the reference signal but also by the temperature of the LED module. It is thus possible to prevent damage to the LEDs caused by a too high temperature.

Preferably, the reference signal generator comprises a zener diode. In this way an accurate reference signal can be generated that is to a large extent not influenced by other voltages and currents in the LED module.

BRIEF DESCRIPTION OF THE DRAWINGS

Embodiments of the invention will be further described making use of a drawing.

In the drawing.

DESCRIPTION OF EMBODIMENTS

Figure 1:
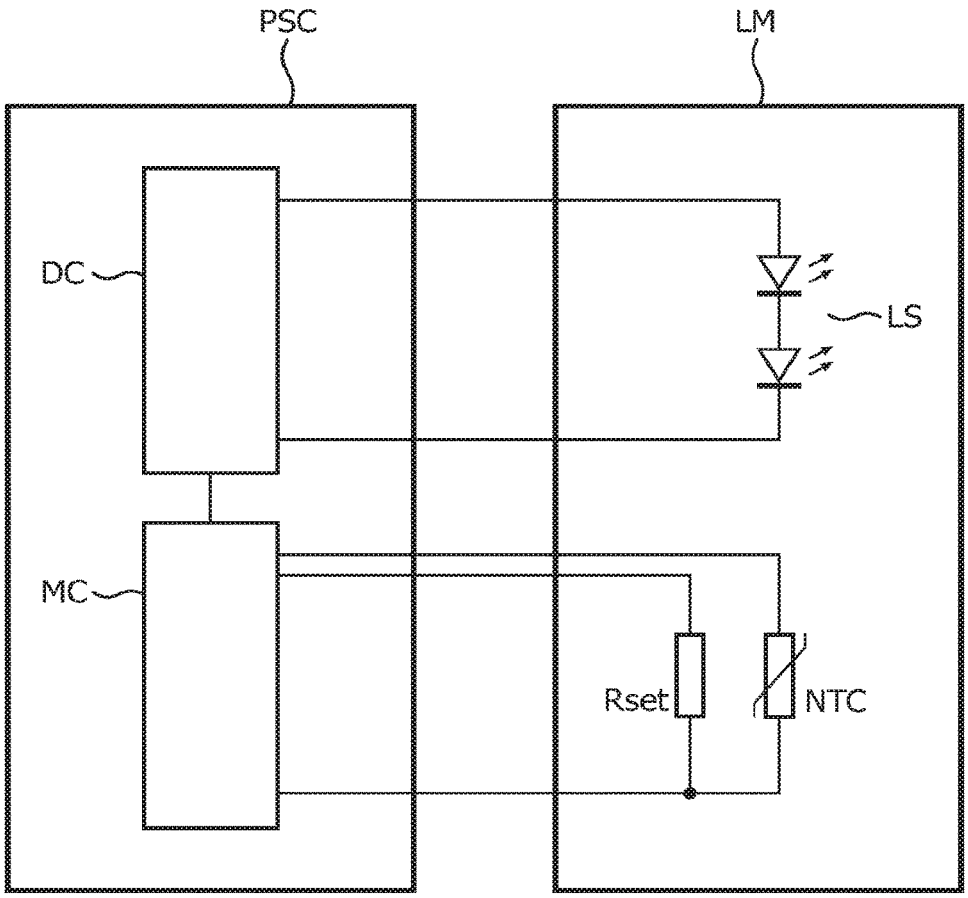
FIG. 1 PRIOR ART
FIG. 1 shows an embodiment of a prior art LED lighting system.
Figure 2:
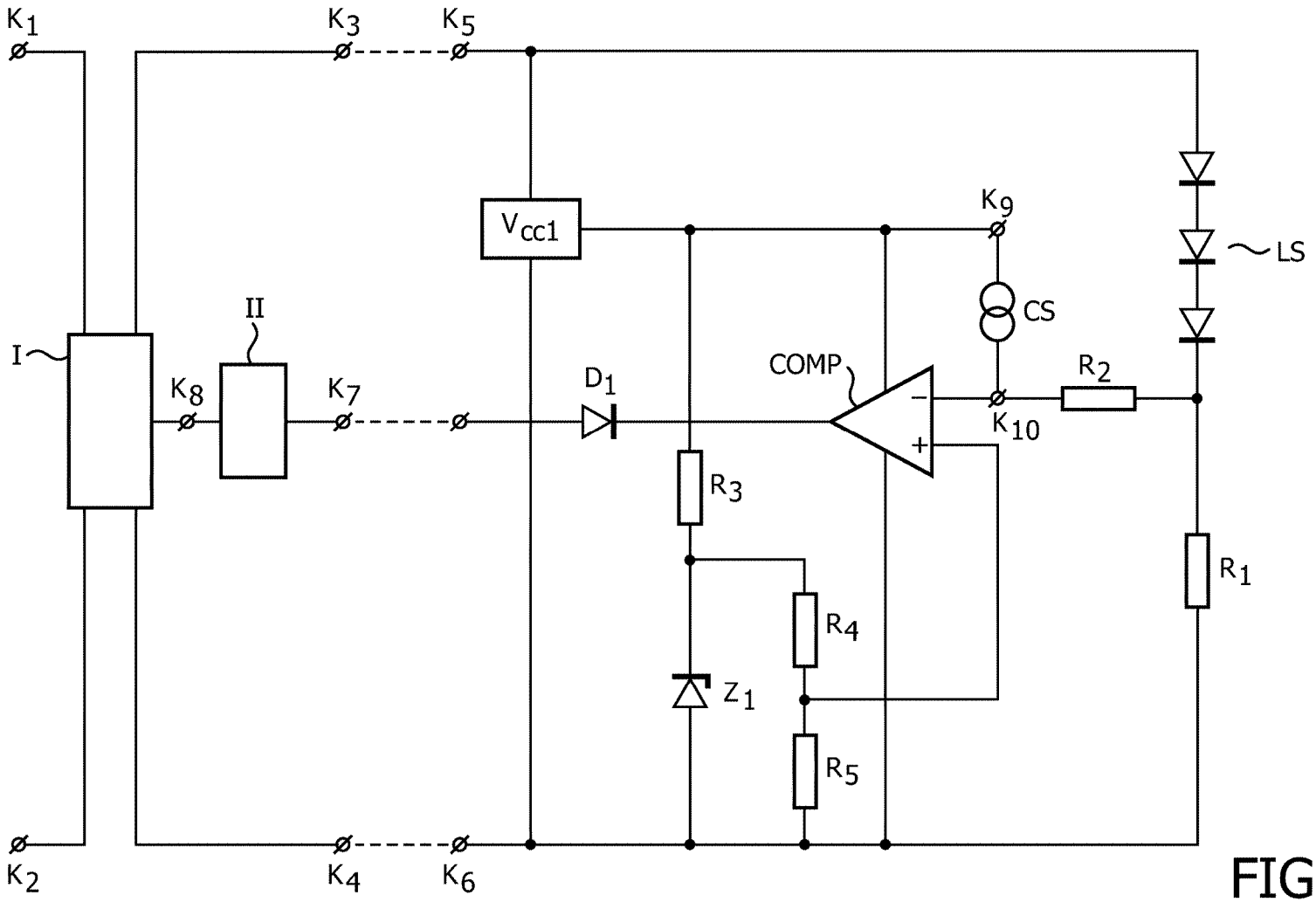
FIG. 2 shows a schematic representation of a first embodiment of a LED lighting system according to the invention.

FIG. 2 shows a schematic representation of a first embodiment of a LED lighting system according to the invention. In FIG. 2 K1 and K2 are input terminals of a power supply circuit for connection to a power supply formed by a supply voltage source. Input terminals K1 and K2 are connected to input terminals of circuit part I. First and second output terminals of circuit part I are connected to a first output terminal K3 and a second output terminal K4 of the power supply circuit respectively. An output terminal K8 of circuit part II is coupled to an input terminal of circuit part I. Circuit part I and circuit part II together form a driver circuit for generating a LED current out of a supply voltage supplied by the supply voltage source and circuit part II is a driver control circuit. Circuit part II is equipped with an input terminal K7 for increasing and decreasing the LED current in dependency of a signal present the input terminal K7 of circuit part II. Input terminals K1 and K2, output terminals K3 and K4 and circuit parts I and II together form the power supply circuit.

Terminals K5 and K6 are first and second input terminals of a LED module for connection to the first and second output terminals K3, K4 of the power supply circuit respectively. Input terminals K5 and K6 are connected by a series arrangement of a LED load LS and a current sensor R1. Input terminals K5 and K6 are also interconnected via input terminals of a voltage supply circuit Vcc1. A common terminal of LED load LS and current sensor R1 is connected to a first input terminal of a comparator COMP via a resistor R2. An output terminal of voltage supply circuit Vcc1 is connected to input terminal K6 by means of a series arrangement of resistor R3 and zener diode Z1. Zener diode Z1 is shunted by a series arrangement of resistors R4 and R5. A common terminal of resistors R4 and R5 is connected to a second input terminal of comparator COMP. Resistors R3, R4 and R5 together with zener diode Z1 form a reference signal generator for generating a reference signal representing a desired magnitude of the LED current. Supply voltage input terminals of comparator COMP are connected to the output terminal of voltage supply circuit Vcc1 and input terminal K6 respectively. A current source CS for supplying a temperature dependent current is coupled between the output terminal of voltage supply source Vcc1 and the first input terminal of comparator COMP via terminals K9 and K10, respectively. An output terminal of comparator COMP is coupled to a cathode of a diode D1. During operation of the LED lighting system formed by the power supply circuit and the LED module, the anode of diode D1 is connected to the input terminal of circuit part I. The current source CS, resistors R2, R3, R4 and R5 together with zener diode Z1 and comparator COMP form a module control circuit for generating a current control signal at an output terminal of the module control circuit formed by the output terminal of comparator COMP, wherein the current control signal has a first value in case a desired value of the LED current is lower than the measured value of the LED current and has a second value in case the desired value of the LED current is higher than the measured value of the LED current. The diode D1 is a unidirectional element comprised in a conductive string forming a coupling circuit connected during operation between the output terminal of the module control circuit and the input terminal of the driver control circuit, for influencing the signal at the input terminal of the driver control circuit in dependency of the current control signal.

The operation of the LED lighting source shown in FIG. 2 is as follows. During operation of the LED lighting system, the input terminals K5 and K6 of the LED module are coupled to the first and second output terminals K3 and K4 of the power supply circuit. Also the output terminal of comparator COMP is connected to the input terminal K7 of the driver control circuit via diode D1 and input terminals K1 and K2 of the power supply circuit are connected to a supply voltage source. In case the LED lighting system comprises more than one LED module, the LED modules are operated in parallel. In other words the first input terminals K5 of the LED modules are connected to each other and to the first output terminal K3 of the power supply circuit, and the second input terminals K6 are connected to each other and to the second output terminal K4 of the power supply circuit. The driver circuit generates a total LED current out of the supply voltage. The voltage across current sensor R1 represents the actual LED current in each LED module and the voltage across resistor R5 represents a desired magnitude of the LED current. Immediately after start-up the magnitude of the LED current is lower than the desired value, so that the signal voltage at the output terminal of the comparator COMP is high. The diode D1 blocks this high signal but the default value of the signal at the input terminal K7 of the driver control circuit is also high, so that the signal at input terminal K7 is high. This high signal voltage at the input terminal of the driver control circuit causes the driver to increase the LED current. The total LED current is thus increased until the actual magnitude of the LED current through the LED load of one of the LED modules becomes higher than the desired magnitude of the LED current so that the signal at the output terminal of the comparator COMP becomes low. As a consequence diode D1 will start conducting and the signal at the input terminal of the driver control circuit also becomes low. This causes the driver circuit to decrease the total LED current. In case only one LED module is connected to the power supply circuit, the LED current is thus controlled at a value substantially equal to the desired magnitude for that LED module. In case the temperature of the LEDs comprised in the LED string LS increases, the current supplied to the first input terminal of the comparator COMP increases as well so that the voltage at the first input terminal of the comparator COMP increases. This causes the signal at the output terminal of the comparator COMP to become low for a lower value of the actual LED current so that the LED current is controlled at a lower value. In this way overheating and damage to the LEDs is prevented.

It is important to note that in case two or more LED modules are connected to the power supply circuit, the LED module that desires the smallest current will signal to the driver control circuit that the current needs to be decreased, while all the other LED modules want their current to be increased. The LED module that desires the smallest current thus overrules all the other LED modules. More in particular, in case only one LED module has a too high temperature while the others have not, the total LED current will be decreased as long as the current control signal of that particular LED module indicates that this decrease is necessary, irrespective of the current control signals generated by the other LED modules. This allows a control of the total LED current over a much wider range than is possible in prior art embodiments wherein each LED module generates a signal representing the current it desires and the total LED current is generated in dependency of the sum of all these signals. As a consequence, in case LED modules designed for different LED currents are connected to the power supply circuit or in case one of the LED modules is overheated, a better protection against damage is realized than by the prior art embodiments.

Figure 4:
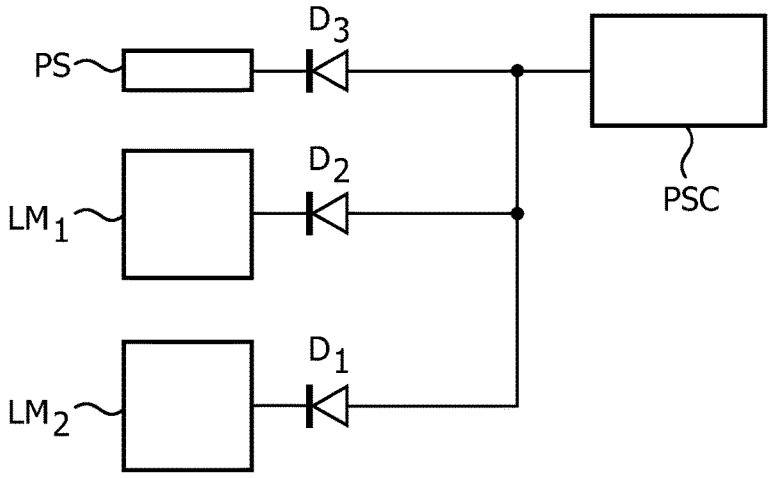
FIG. 4 shows a schematic representation of the first embodiment of a LED lighting system according to the invention as shown in FIG. 2 including more than one LED module and a parameter sensor.

FIG. 4 represents an embodiment of a LED lighting system according to the invention as shown in FIG. 2, comprising a power supply circuit PSC, two LED modules LM1 and LM2 and a parameter sensor PS. The LED modules LM1 and LM2 and the parameter sensor PS are all coupled to the power supply circuit by means of a coupling circuit comprising respectively diodes D1, D2 and D3. The input terminals of LED modules LM1 and LM2 are coupled to the output terminals of the power supply circuit PSC. These latter connections are not shown in FIG. 4. The parameter sensor PS can be connected to the output terminals of the power supply circuit, which is not shown in FIG. 4. The parameter sensor can also, for example, be powered by a battery comprised in the parameter sensor.

The parameter sensed by the parameter sensor can for example represent the total intensity of the light generated by the LED lighting system and the ambient light. It can also be the temperature at a particular spot in the LED lighting system, the presence of persons in the vicinity of the LED lighting system and/or a signal from a remote control.

The current control signal, also referred to as a sensor signal and which is present at the output of the parameter sensor, can have a first or a second value, like the first and second value of the current control signal generated by the module control circuits of the LED modules.

In case the parameter represents the total intensity of the light and this intensity is lower than a predetermined reference value representing a desired light level, the signal at the output terminal of the parameter sensor has its second value and the LED current is supplied to the LED modules as described here-above and not being influenced by the parameter sensor, because diode D3 blocks the second signal. However, in case the total intensity of the light is higher than the predetermined reference value, the signal at the output terminal of the parameter sensor adopts its first value, this first value is communicated to the input terminal of the driver control circuit comprised in the power supply circuit PSC and the driver circuit thus decreases the total LED current until the total light intensity equals the desired light level.

Similarly, in case the parameter represents the temperature at a certain spot in the LED lighting system, the LED current can be decreased by the parameter sensor in case the temperature is higher than a predetermined reference value. Also in this case, the parameter sensor does not interfere with the operation of the LED lighting system in case the temperature is lower than the predetermined reference value.

In case the parameter represents a presence of persons in the vicinity of the LED lighting system, the LED lighting system can be switched off or dimmed by the parameter sensor in case no presence is detected. In case a presence is detected, the operation of the LED lighting system is unaffected by the parameter sensor.

In case the parameter represents a signal from a remote control, this signal can for example be used to adjust the sensor signal to its first value, so that the LED current generated by the power supply circuit is reduced to zero and the LED lighting system is thus switched off.

It will be clear to the skilled person that it is of course possible to choose many other parameters, or combinations of parameters, than the ones mentioned here-above by way of example, in a parameter sensor, to switch the LED lighting arrangement off or to dim it in case these other parameter indicate that this is desirable.

Figure 3:
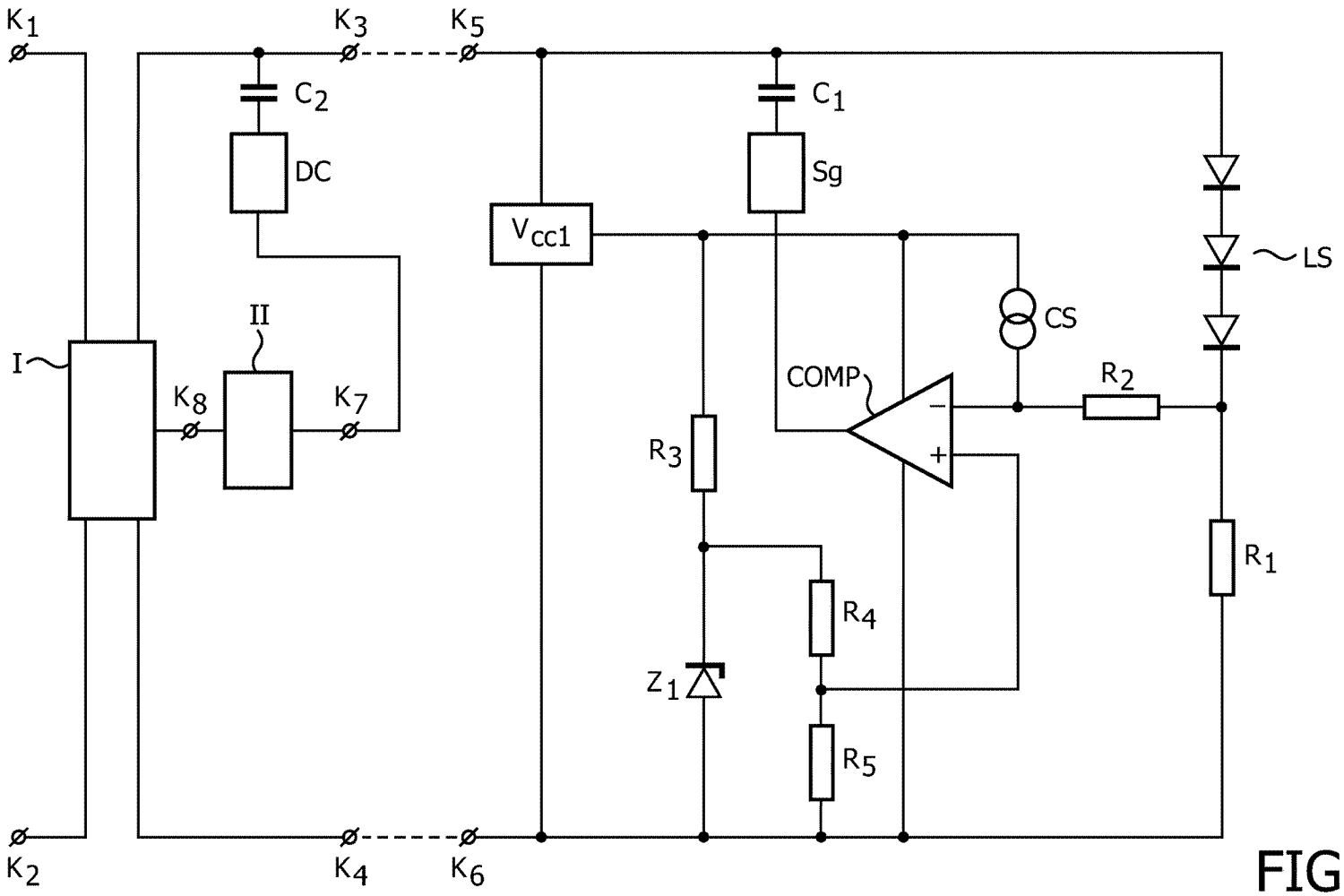
FIG. 3 shows a schematic representation of a second embodiment of a LED lighting system according to the invention.

In FIG. 3 another embodiment of a LED lighting system according to the invention is shown. Components and circuit parts that are similar to those in the first embodiment shown in FIG. 2 are labeled with the same reference signs. In the LED module shown in FIG. 3, the diode D1 of the FIG. 2 embodiment is dispensed with and the output terminal of the comparator COMP is connected to an input terminal of a signal generator Sg for generating a communication signal. A capacitor C1 is coupled to the first input terminal K5 of the LED module and the signal generator Sg. An input terminal of a circuit part DC is coupled to the first output terminal K3 of the power supply circuit via a capacitor C2. An output terminal of circuit part DC is connected to an input terminal K7 of circuit part II which is the driver control circuit. For the remaining part the LED module does not differ from the embodiment shown in FIG. 2. Capacitor C2 and circuit part DC together form a detection circuit for detecting the communication signal and for controlling the signal at the input terminal K7 of the driver control circuit II so that the LED current is decreased in case the communication signal is detected and increased in case the detection circuit does not detect the communication signal. The detection circuit may comprise for example a lock-in-amplifier or a sensitive tone detector.

The operation of the embodiment shown in FIG. 3 is as follows. The driver circuit generates a LED current out of the supply voltage. The voltage across current sensor R1 represents the actual LED current and the voltage across resistor R5 represents a desired magnitude of the LED current. Immediately after start-up the magnitude of the LED current in all the connected LED modules is lower than the desired value, so that the signal voltage at output terminal of the comparator COMP is at its second value, i.e. high. This high value is present at the input terminal of circuit part SG. This high value does not activate signal generator Sg so that no communication signal is generated by signal generator Sg and detected by circuit part DC, so that the signal at the input terminal of the driver control circuit adopts its default value (high) and the total generated LED current is thus increased by the driver. The total LED current to all the connected modules is thus increased until the actual magnitude of the LED current becomes higher than the desired magnitude of the LED current of one of the connected LED modules, so that the signal at the output terminal of the comparator COMP will adopt its second value, i.e. low. As a consequence signal generator Sg is activated and generates a communication signal that is coupled to the first input terminal K5 of the LED module via capacitor C1.

Since during operation input terminal K5 of the LED module is connected to first output terminal K3 of the power supply circuit, the communication signal is also present at first output terminal K3 and is thus detected by the detection circuit formed by capacitor C2 and circuit part DC. The signal at the output terminal of circuit part DC becomes low and thus the signal present at the input terminal of the driver control circuit becomes low and the driver circuit decreases the total LED current. The LED current is thus controlled at a magnitude substantially equal to the desired magnitude.

The influence of the temperature of the LEDs in the LED string LS is realized in the same way as in the embodiment shown in FIG. 2.

The embodiment shown in FIG. 3 offers the important advantage that no additional wires are used to communicate the current control signal to the power supply circuit. In case the LED lighting system comprises more than one LED module, the LED modules are operated in parallel. In other words, the first input terminals K5 of the LED modules are connected to each other and to the first output terminal K3 of the power supply circuit, and the second input terminals K6 are connected to each other and to the second output terminal K4 of the power supply circuit.

The embodiment shown in FIG. 3 also offers the advantages of the embodiment shown in FIG. 2. In case of more than one LED module the current control signal of the LED module designed for the lowest LED current overrules the current control signals of the other LED modules, and in case overheating takes place in one of the LED modules, the total LED current and thus also the LED current through the overheated module can be adjusted over a wide range.

Figure 5:
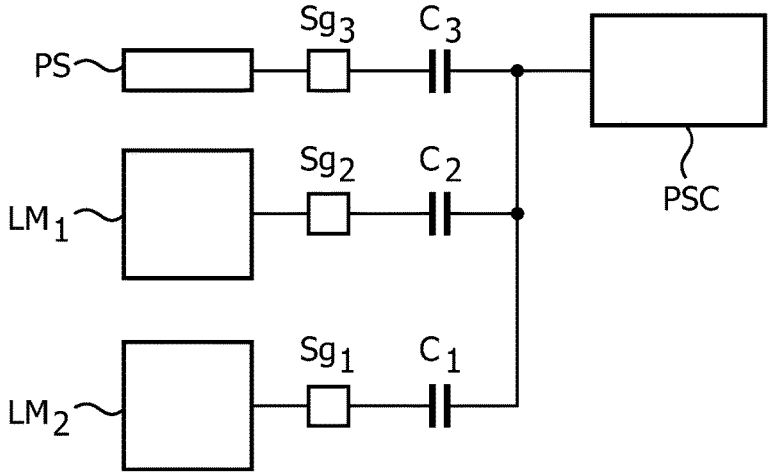
FIG. 5 shows a schematic representation of the second embodiment of a LED lighting system according to the invention as shown in FIG. 3 including more than one LED module and a parameter sensor.

FIG. 5 represents an embodiment of a LED lighting system according to the invention as shown in FIG. 3, comprising a power supply circuit PSC, two LED modules LM1 and LM2 and a parameter sensor PS. The LED modules LM1 and LM2 and the parameter sensor PS are all coupled to the power supply circuit PSC by means of a coupling circuit comprising respectively first signal generator Sg1 and capacitor C1, second signal generator Sg2 and capacitor C2, and third signal generator Sg3 and capacitor C3. The input terminals of LED modules LM1 and LM2 are coupled to the output terminals of the power supply circuit PSC. These latter connections are not shown in FIG. 5. The parameter sensor PS can be connected to the output terminals of the power supply circuit, which is not shown in FIG. 5. The parameter sensor can also for example be powered by a battery comprised in the parameter sensor.

The operation of the embodiment shown in FIG. 5 is very similar to that of the embodiment in FIG. 4. The output terminal of parameter sensor PS is coupled to the first output terminal of the power supply circuit PSC via the third signal generator Sg3 and the capacitor C3. As shown in FIG. 3, the power supply circuit comprises a detection circuit coupled between the first output terminal and the input terminal of the driver control circuit. Consequently, when the signal at the output terminal of the parameter sensor is low, the signal at the input terminal of the driver control circuit also becomes low, via the third signal generator Sg3 and the detection circuit comprised in the power supply circuit PSC, and thus the current is decreased to a dim level or to zero. When the signal at the output terminal of the parameter sensor PS is high, the LED lighting system operates unaffected by the parameter sensor, because the signal generator SG3 is not activated. The parameters can be the ones as exemplified in the exemplary embodiment of FIG. 4, or as other parameters.

Figure 6:
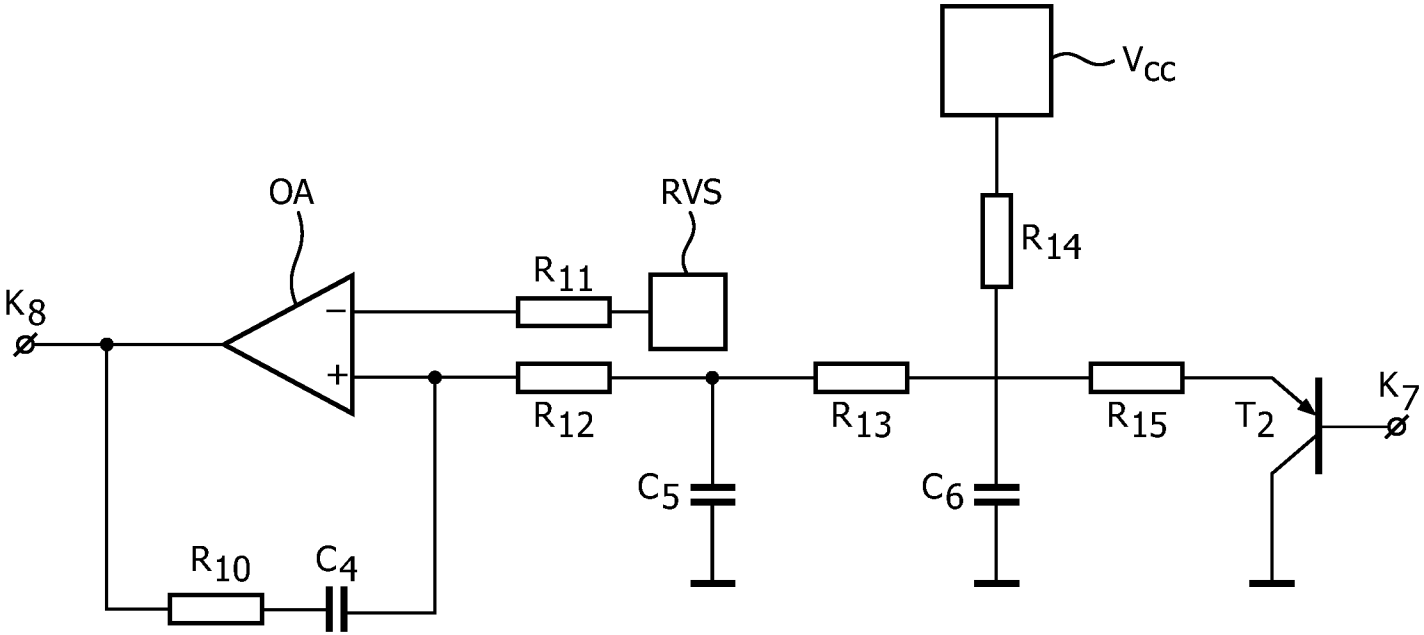
FIG. 6 shows an embodiment of a driver control circuit comprised in the embodiments shown in FIG. 2 and FIG. 3.

FIG. 6 show an embodiment of circuit part II, the driver control circuit comprised in the embodiments of the LED lighting systems shown in FIG. 2 and FIG. 3. Resistors R10, R11, R12 and R13, capacitors C4 and C5, operational amplifier OA and reference voltage source RVS together form an integrator. Supply voltage source Vcc, resistors R13, R14 and R15, capacitor C6, transistor T2 and the integrator together form a circuit part that ensures that the voltage at the output terminal K8 continuously increases in case the voltage at the input terminal K7 is high and decreases continuously in case the voltage at input terminal K7 is low. In case the driver control circuit is implemented as shown in FIG. 6, the driver circuit, or in other words circuit part I, can be implemented as a circuit part that generates a DC current that is proportional to the voltage present at its input terminal.

Figure 7:
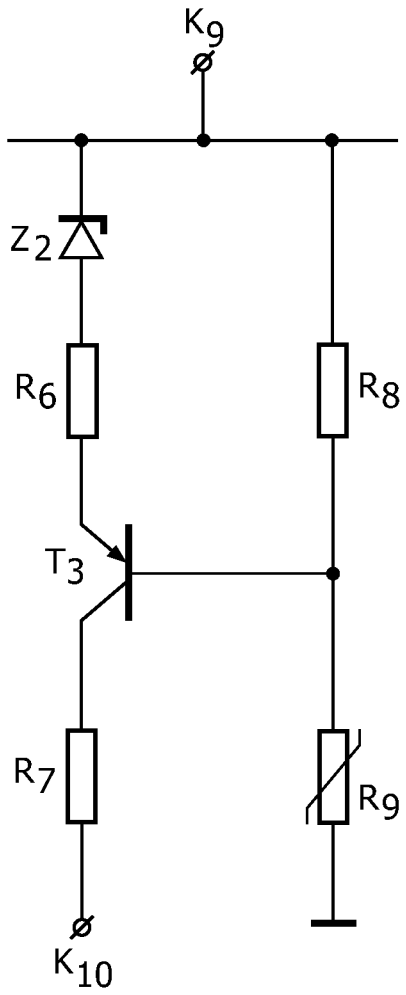
FIG. 7 shows an embodiment of a current source comprised in the embodiments shown in FIG. 2 and FIG. 3.

FIG. 7 shows an embodiment of the current source CS comprised in the embodiments of a LED lighting system shown in FIG. 2 and FIG. 3. The current source comprises resistors R6, R7, R8 and R9, transistor T3 and zener diode Z2. The current supplied by the current source is controlled by the voltage at the base of transistor T3. Resistor R9 is a temperature dependent resistor of the type NTC. In case the temperature increases, the resistance of resistor R9 decreases, so that the voltage at the basis of transistor T2 drops, so that the current generated by the current source CS increases.

While the invention has been illustrated and described in detail in the drawings and foregong description, such illustration and description are to be considered illustrative or exemplary and not restrictive; the invention is not limited to the disclosed embodiments.

Variations to the disclosed embodiments can be understood and effected by those skilled in the art in practicing the clamed invention, from a study of the drawings, the disclosure, and the appended claims. In the claims, the word "comprising" does not exclude other elements or steps, and the indefinite article "a" or "an" does not exclude a plurality. A single processor or other unit may fulfill the functions of several items recited in the claims. The mere fact that certain measures are recited in mutually different dependent claims does not indicate that a combination of these measures cannot be used to advantage.

The invention claimed is:

1. An LED light system comprising a power supply circuit and one or more LED modules, wherein the power supply circuit comprises:

input terminals for connection to a power supply source and first and second output terminals a driver circuit coupled between the input terminals and the first and second output terminals for generating a LED current, the driver circuit comprising a driver control circuit equipped with an input terminal for increasing or decreasing the LED current in dependency of a signal present at the input terminal of the driver control circuit, and wherein each of the one or more LED modules comprises:

first and second input terminals for connection to respectively the first and second output terminals of the power supply circuit, a series arrangement of a LED load and a current sensor coupled between the input terminals, a module control circuit for generating a current control signal at an output terminal of the module control circuit and coupled to the current sensor and to a reference signal generator for generating a reference signal representing a desired magnitude of the LED current, wherein the current control signal has a first value in case the desired magnitude of the LED current is lower than a measured value of the LED current and a second value in case the desired value of the LED current is higher than the measured value of the LED current, and a coupling circuit during operation coupled between the output terminal of the module control circuit and the input terminal of the driver control circuit, for communicating the first value of the current control signal to the input terminal of the driver control circuit and for blocking the second value, and wherein the signal at the input terminal of the driver control circuit has a default value when all the current control signals from the one or more modules have their second value.

2. The LED light system as claimed in claim 1, wherein the coupling circuit comprises a conductive string comprising a unidirectional element, such as a diode, that blocks the second value of the current control signal and conducts the first value of the current control signal.

3. The LED light system as claimed in claim 1, wherein the default value is chosen such that the LED current is increased when the signal present at the input of the driver control circuit has the default value.

4. The LED light system as claimed in claim 1, wherein the LED module comprises a signal generator coupled between the output of the module control circuit and the first input terminal of the LED module, for generating a communication signal and for coupling the communication signal to the first input terminal in case the current control signal has its first value, and wherein the power supply circuit comprises a detection circuit coupled between the input terminal of the driver control circuit and the first output terminal of the power supply circuit for detecting the communication signal and for controlling the signal at the input terminal of the driver control circuit so that the LED current is decreased in case the communication signal is detected and increased in case the detection circuit does not detect the communication signal, wherein the coupling circuit is formed by the signal generator and the detection circuit.

5. The LED light system as claimed in claim 1, wherein the LED system comprises two or more LED modules.

6. The LED light system as claimed in claim 1, wherein the LED lighting system comprises a parameter sensor for sensing a parameter and for generating a current control signal at an output terminal of the parameter sensor equal to the first value or the second value of the current control signal generated by the module control circuits of the LED modules in dependency of the result of the sensing, wherein the output terminal of the parameter sensor is coupled to the input terminal of the driver control circuit via a coupling circuit for conducting the first value and blocking the second value of the sensor signal, and wherein the parameter is chosen from a group comprising the total intensity of the ambient light and the light generated by the LED lighting system, the temperature at a particular spot in the LED lighting system, the presence of persons in the vicinity of the LED lighting system and a signal from a remote control.

7. The LED light according to claim 6, wherein the coupling circuit of the parameter sensor comprises a unidirectional element.

8. The LED light system as claimed in claim 4, wherein coupling circuit of the parameter sensor comprises a signal generator coupled between the output terminal of the parameter sensor and the first output terminal of the power supply circuit, for generating a communication signal and for coupling the communication signal to the first output terminal of the power supply circuit.

9. The LED light system as claimed in claim 1, wherein the module control circuit comprises a comparator having a first input terminal coupled to the current sensor and having a second input terminal coupled to the reference signal generator.

10. The LED light system as claimed in claim 9, wherein one of the input terminals of the comparator is coupled to an output terminal of a current source generating a temperature dependent current.

11. The LED light system as claimed in claim 1, wherein the reference signal generator comprises a zener diode.

12. A method for operating at least one LED module comprising a LED load by means of a driver circuit comprised in a power supply circuit, the method comprising the following steps:

providing a module control circuit in each LED module for generating a current control signal in dependency of a measured magnitude of a LED current and a desired magnitude of the LED current, the current control signal having a first value in case the desired value of the LED current is lower than the measured value of the LED current and a second value in case the desired value of the LED current is higher than the measured value of the LED current, providing a driver control circuit in the power supply circuit, wherein the driver control circuit is equipped with an input terminal, for increasing or decreasing the LED current in dependency of a signal present at the input terminal of the driver control circuit and, adjusting the signal at the input terminal of the driver control circuit in dependency of the current control signal.

* * * * *